US006341773B1

(12) United States Patent
Aprato et al.

(10) Patent No.: US 6,341,773 B1
(45) Date of Patent: Jan. 29, 2002

(54) DYNAMIC SEQUENCER FOR SHEETS OF PRINTED PAPER

(75) Inventors: Armando Aprato, Lugnacco; Alberto Massucco; Giuliano De Marco, both of Ivrea; Franco Terrusi, Milan, all of (IT)

(73) Assignee: Tecnau S.r.l., Ivrea (IT)

( * ) Notice: Subject to any disclaimer, the term of this patent is extended or adjusted under 35 U.S.C. 154(b) by 0 days.

(21) Appl. No.: 09/589,284

(22) Filed: Jun. 8, 2000

(30) Foreign Application Priority Data

Jun. 8, 1999 (IT) ..... TO99A0482

(51) Int. Cl.[7] ..... B65H 3/44

(52) U.S. Cl. ..... 271/9.13; 271/225; 270/52.09; 270/52.01

(58) Field of Search ..... 271/9.12, 9.13, 271/225, 184; 83/934; 225/99; 198/418.1, 418.3, 418.4; 270/52.01, 52.07, 52.08, 52.09, 58.01; 242/615.21

(56) References Cited

U.S. PATENT DOCUMENTS 2,214,593 A * 9/1940 Mustin et al. ..... 270/52.09 X
3,693,486 A * 9/1972 Maniaci et al. ..... 83/934 X
5,104,104 A * 4/1992 Mol ..... 270/52.08
5,439,208 A 8/1995 Moser et al. ..... 271/225
6,062,556 A * 5/2000 McCay ..... 271/9.13

* cited by examiner

*Primary Examiner*—Christopher Curtis
*Assistant Examiner*—Patrick Mackey
(74) *Attorney, Agent, or Firm*—Banner & Witcoff, Ltd.

(57) ABSTRACT

A dynamic sequencer (17) for sheets printed two-up and slalom on continuous forms comprising an input section (22) for two sheets (19-*a* and 19-*b*) in a plane flanking relationship with respect to a longitudinal axis (27) and a collecting station (24) for the superposed sheets. Overlapping device (23) moves the sheets from the input section (22) to the collecting station (24) along two respective trajectories (28, 29) maintaining a constant transversal trim. The trajectories (28, 29) include divergent portions (31, 32) divergent in height from the input section, approaching portions (33, 34) approaching the sheets toward the longitudinal axis (27) and concurrent portions (36, 37) concurrent in height toward the collecting station (24).

25 Claims, 5 Drawing Sheets

DYNAMIC SEQUENCER FOR SHEETS OF PRINTED PAPER

FIELD OF THE INVENTION

The present invention relates to a dynamic sequencer for sheets of printed paper and more particularly to a dynamic sequencer for sheets of paper printed in two-up and slalom for being used in a files forming machine and comprising an input section for two sheets lying in a flanking relationship with respects to a longitudinal axis and a collecting station for collecting the superposed sheets.

BACKGROUND OF THE INVENTION

Generally, the files forming machines utilize laser printers, which, for reason of cost and velocity, print the data on continuous forms with perforated edges having the width of two flanked sheets. In fact, the cost of a laser printing for commercial purposes depends on the number of rows and not on their width. The sheets are printed together, as alternated couples, on the moving form and according to the method known as in "two-up" and "slalom." A sequencer device separates the sheets by means of longitudinal and transversal cuts on the form and superimposes the individual sheets, in sequence, for the formation of the files in the established order.

A sequencer for sheets of paper printed in two-up is known in which the sheets separated from the continuous form are temporarily arrested in front of a conveyor belt disposed perpendicularly to and beneath the cutting station. Two solenoids are simultaneously actuated for pushing the sheets on the conveyor belt. Then, the belt superimposes the sheets, in the sense of the width, against stop elements of another conveyor belt. In view of the intermittent movement of the sheets, a sequencer of this type is relatively time-consuming in the forming of the files. Further, the transversal disposition of the conveyor belt is the cause of an excessive encumbrance of the files forming machine.

A known dynamic sequencer of printed sheets provides to engage the sheets with two deflectors after the separation from the form. The deflectors twist the sheets and upset them on a transversal conveyor belt for the collection of the file. This sequencer is quick but results rather expensive and bulky owing to he catching mechanism necessary to assuring a twisting without jams of the separated sheets. Further the files will result upset, with difficulties fin positioning data reading devices and rotated through 90° with respect to the axis of advancing , with difficulties in the operation of a following device.

SUMMARY OF THE INVENTION

The principal object of the present invention is therefore to provide a dynamic sequencer for two-up and slalom printed sheets to be used in files forming machines performing a high productivity and resulting of costs and dimensions relatively limited.

This object is achieved by the dynamic sequencer of the above mentioned type, comprising overlapping means for moving the sheets of a file from the input section to the collecting station along two respective trajectories, in which the overlapping means provides a transversal constant trim, and in which the trajectories of the sheets include at least a divergent portion divergent in height from the input section, at least an approaching portion for approaching, in projection, at least a sheet toward another sheet along the longitudinal axis and at least a concurrent portion for causing at least a sheet to be concurrent in height toward the collecting station in a superimposed relationship with another sheet of the file.

The characteristics of the invention will become clear from the following detailed description of a preferred embodiment given purely by way of non-limitative example with the aid of the accompanying drawings wherein:

DESCRIPTION OF THE PREFERRED EMBODIMENTS

Figure 1:
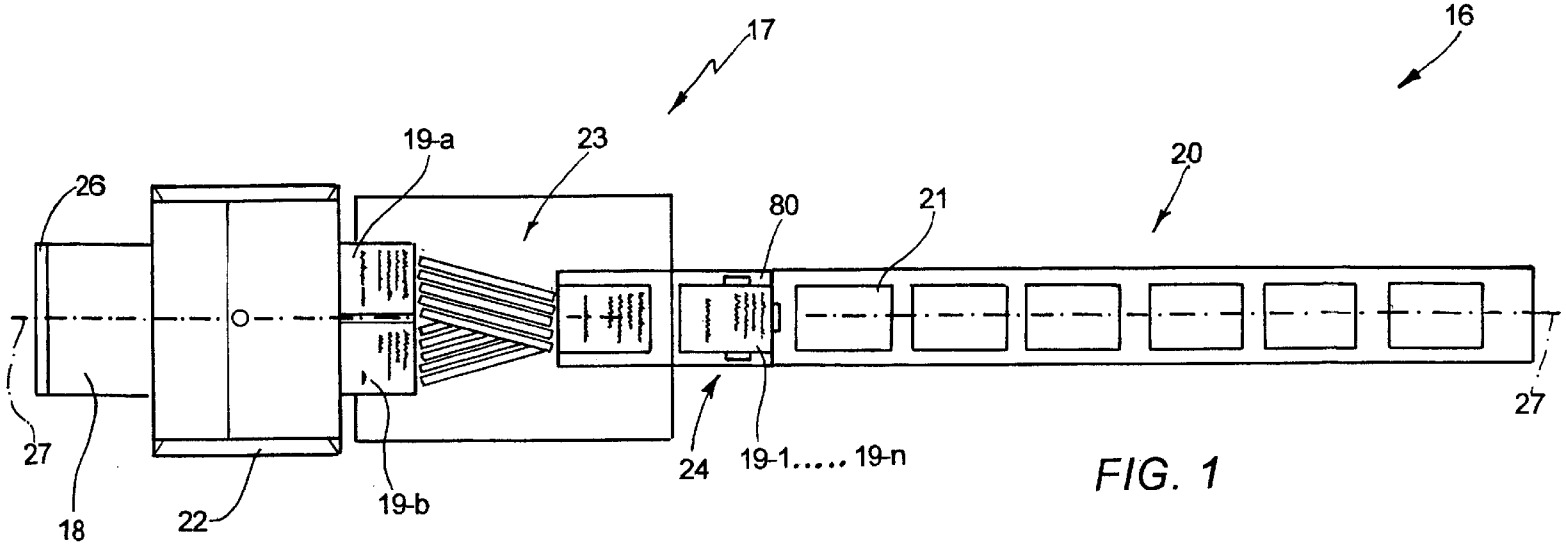
FIG. 1 represents a schematic plan view of a files forming machine including a dynamic sequencer for printed sheets according to the invention.

With reference to FIG. 1, number 16 represents a portion of a machine for forming printed files, including a dynamic sequencer 17 according to the invention.

The files forming machine comprises a printer laser of known type disposed upstream of the portion 16 and not shown in the drawings, and an output conveyer belt 20.

As for the present invention, a file 21 is constituted by a plurality of sheets 19-1, 19-2 . . . **19-*n* and the laser printer provides to print the content of all the sheets 19-1, 19-2 . . . 19-*n* on a continuous form 18** according to the technique known as "two-up" and "slalom."

Figure 2:
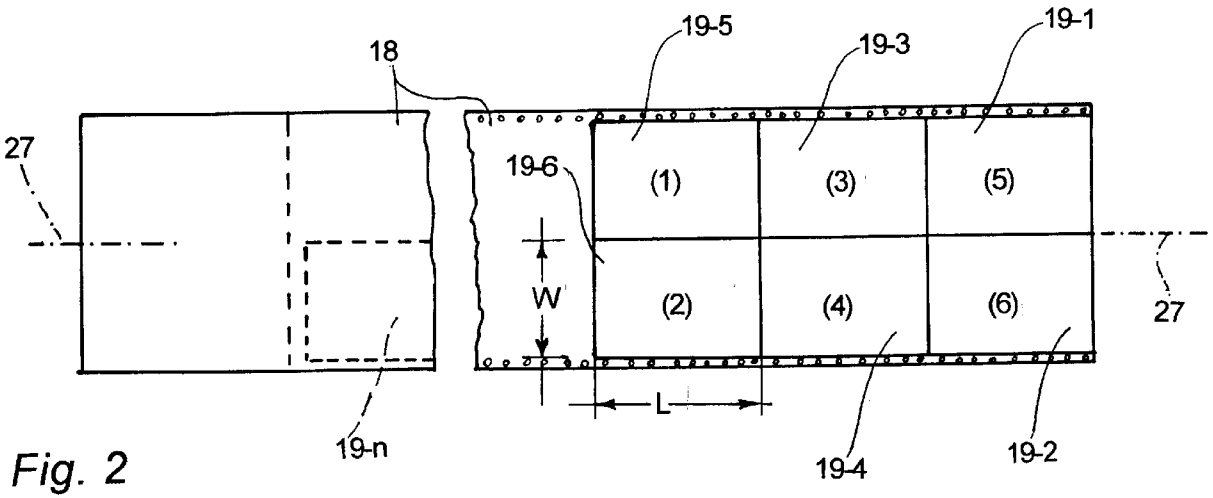
FIG. 2 shows a scheme of printing for the sheets of the sequencer of FIG. 1.

For example, a file 21 with six sheets can be printed on the form 18 in slalom, as represented in FIG. 2, in accordance with the order (6), (5), (4), (3), (2), (1) and in which the sheets 19-1, 19-2; 19-3, 194; and 19-5, 19-6 result in a flanking relationship. The sheets 19-1 to 19-6 can be also sequenced to define two files of three sheets to be printed in the order (6), (5) and (4) and (3), (2) and (1), respectively.

The dynamic sequencer 17 of the invention comprises an input section 22, overlapping means 23, and a collecting station 24. The input section 22 is adjacent to the laser printer for separating two sheets **19-*a* and 19-*b* from the form 18 and disposing them in a flanging (two-up) relationship. The overlapping means 23, guide and move the sheets up to an overlapping condition, and the collecting station 24 collects the files 21 and delivers them toward the output conveyer belt 20** of the machine.

Specifically, the input section 22 defines a longitudinal horizontal axis 27 and comprises a static and/or dynamic cutter means not shown in the drawings. The cutter means executes transversal and longitudinal cuts on the forms 18, such to separate the sheets **19-*a* and 19-*b*, each of a given width "W" and a length "L". The form 18 unwinds along a horizontal axis parallel to the axis 27 and the section 22 provides to present the sheets 19-*a* and 19*b* on a horizontal support plane 26 at the sides of the longitudinal axis 27**.

Figure 3:
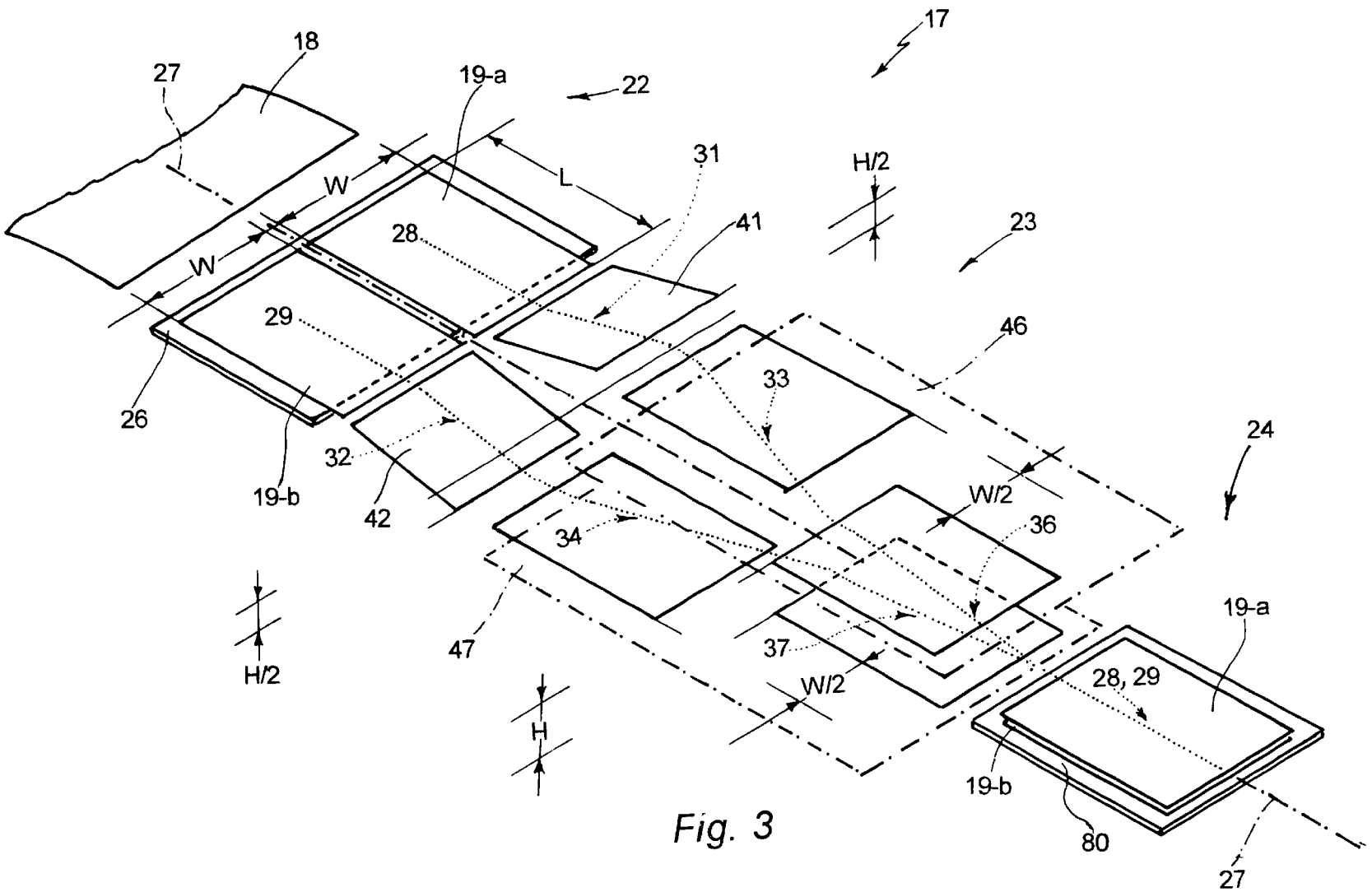
FIG. 3 shows a scheme representative of the formation of files according to the invention.
Figure 4:
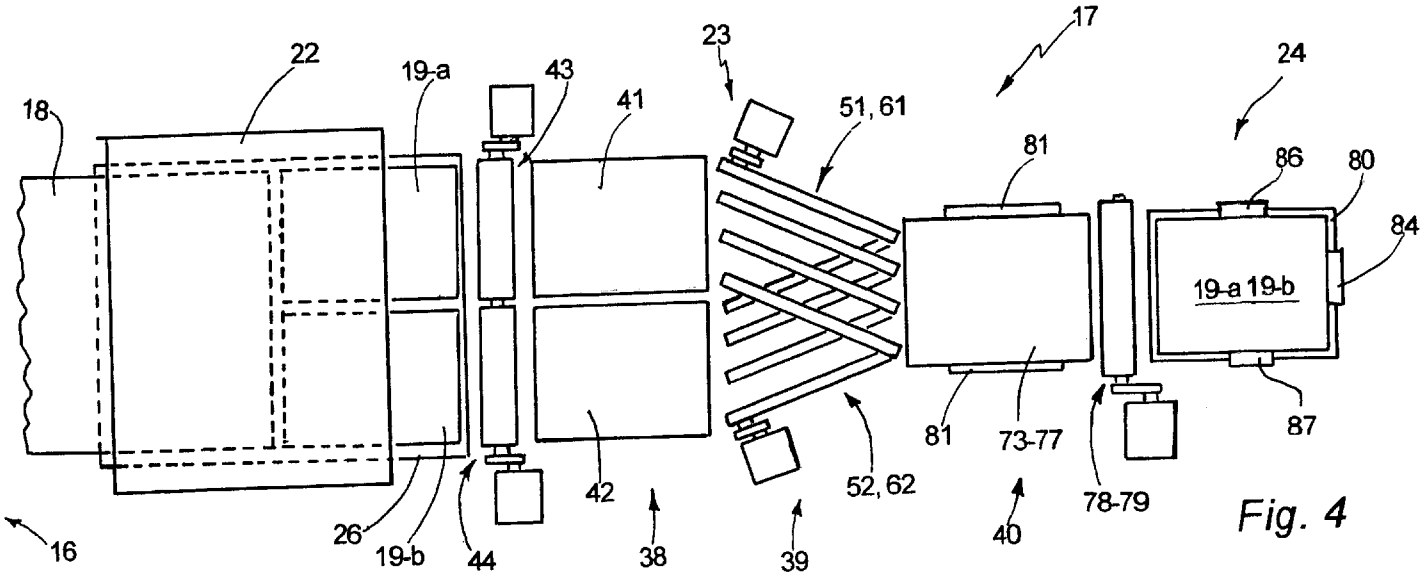
FIG. 4 shows a schematic plan view of the sequencer of the invention.
Figure 6:
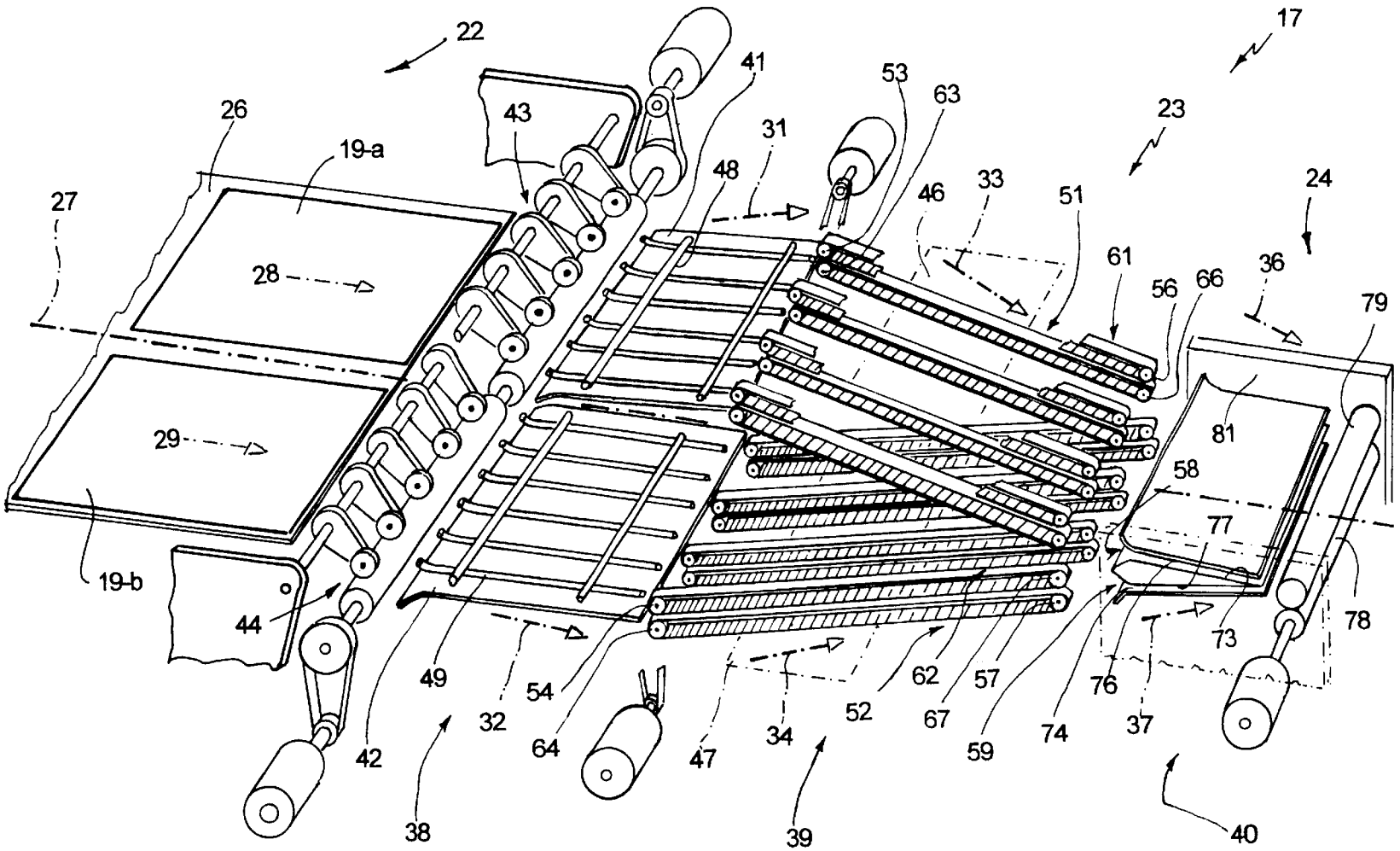
FIG. 6 represents a schematic perspective view of the sequencer according to the invention.

In accordance with the invention the overlapping means 23 (FIGS. 3, 4 and 6) guide and move the sheets **19-*a*, 19-*b*** from the input section 22 to the collecting station 24 along two respective trajectories 28, 29. These trajectories cross in diagonal in the space and are such to maintain the sheets in a transversal trim substantially constant and horizontal.

The trajectories 28, 29 include divergent portions 31, 32, approaching portions 33, 34 and concurrent portions 36, 37. The divergent portions 31, 32 are divergent in height from the support plane 26; the approaching portions 33, 34 are of constant height and approach the sheets in diagonal toward a geometrical vertical surface passing through the longitudinal axis 27; and the concurrent portions 36, 37 are concurrent in height toward the collecting station 24.

Suitably, the overlapping means 23 comprise a divergence unity 38, a crossing unity 39 and a convergence unity 40 which are set in cascade along the axis 27 between the input section 22 and the collection station 24. The divergence unity 38 is provided for guiding and moving the sheets 19-*a*, 19-*b* along the respective divergent portions 31, 32 of the trajectories 28, 29; the crossing unity 39 guides and moves the sheets along the approaching portions 33, 34; and the convergence unity 40 guides and moves the sheets along the concurrent portions 36, 37.

The divergence unity 38 comprises two inclined planes 41 and 42 for guiding the sheets 19-*a* and 19-*b*, respectively, and two extractors 43 and 44 disposed transversely to the support plane 26. The inclined planes 41 and 42 pass through the divergent portions 31 and 32 and the extractors 43 and 44 are designed for engaging the sheets of the plane 26 and moving them along the planes 41 and 42. The leading edges of these planes are aligned each other and adjacent to the extractors 43 and 44, whilst the trailing edges are disposed at different heights, adjacent to respective horizontal movement surfaces 46 and 47. These surfaces 46 and 47 are positioned one above the other, spaced apart a distance "H" in height, and pass through the approaching portions 33 and 34 of the trajectories 28, 29.

Figure 5:
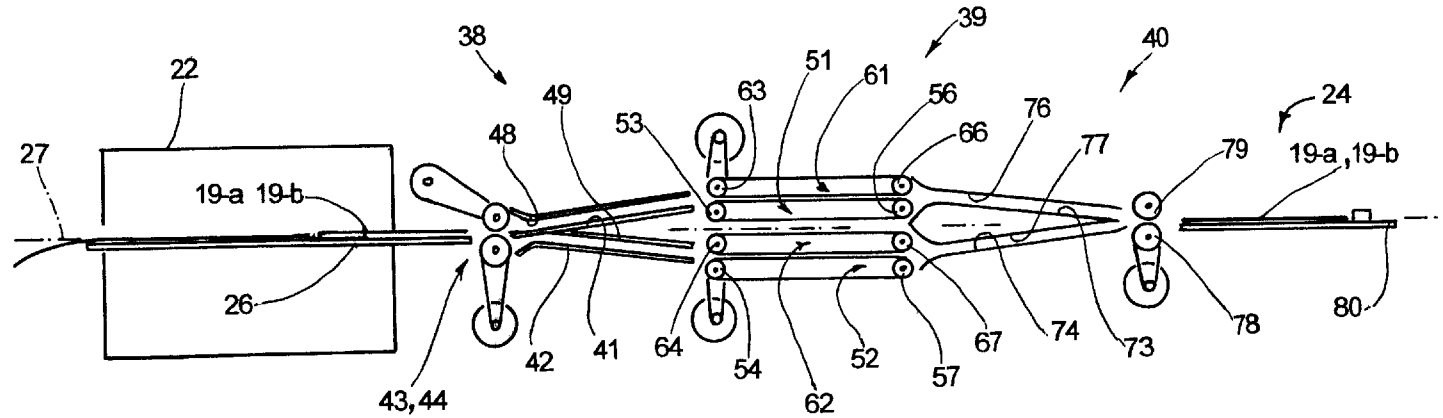
FIG. 5 represents a lateral view of the sequencer of FIG. 4.

The inclined plane 41 (see FIG. 5) is ascending with respect to the support plane 26 for dragging the sheet 19-a on the movement surface 46 to a height "H/ 2" above the support plane 26. The inclined plane 42 is descending for dragging the sheet 19-*b* on the movement surface 47 to a height "H/2" under the plane 26.

Upper guide elements 48, 49 are provided for guiding the sheets 19-*a*, 19-*b* along the inclined planes 41, and 42. For example, these elements 48, 49 are constituted by longitudinal gratings having capability of removal and which define with the planes 41 and 42 respective channels for the passage of the sheets 19-*a* and 19-*b*.

The extractors 43 and 44 comprise each two motorized taking-up rollers and contrast rollers disposed between the support plane 26 and the leading edges of the inclined planes 41 and 42. These extractors are designated for extracting the sheets 19-*a* and 19-*b* from the plane 26, up to bring their leading edges close to the movement surfaces 46 and 47. It is performed by maintaining a constant trim and with the longitudinal axes of the sheets lying on the planes passing through the divergent portions 31 and 32 of the trajectories 28 and 29.

The couples of rollers of the extractors 43 and 44 are separately motorized and can be actuated either in synchronism or in sequence. In the first case, the sheets are moved in pair for forming files with an even number of sheet. In the case of actuating in sequence, one of the two sheets 19*a*, 19-*b* can be stopped whilst the other proceeds toward the collecting station 24 to define files with an odd number of sheets.

The crossing unity 39 comprises two groups of conveyer belts 51 and 52 suitably motorized and positioned at different heights. The groups of conveyer belts 51 and 52 are provided for dragging the sheets 19-*a* and 19-*b*, respectively, and in which each conveyer belt has an upper and a lower section. The directions of motion of the two groups of conveyer belts are inclined in diagonal in the space and concurrent in plane toward a common direction corresponding, in projection, to the longitudinal axis 27. Adjacent to the inclined planes 41 and 42, the groups 51 and 52 extend for a width a few larger than "2W". Adjacent to the unity 40, these groups extend for a width a few larger than "W". The length of the conveyer belts 51 and 52 is a few longer than he length "L" of the sheets 19-*a* and 19-*b*.

In detail, the upper sections of the conveyer belts of the group 51 are tangent and define the movement surface 46 and are disposed at the sides of and parallel to the divergent portion 33 of the trajectory 28. The upper sections of the belts of the group 52 are tangent and define the movement surface 47 and are disposed at the sides of and parallel to the portion 34 of the trajectory 29. Furthermore, the direction of dragging of the conveyer belts of the group 51 and that of the belts of the group 52 result, in plane, symmetrically confluent toward the axis 27.

The conveyer belts of the groups 51 and 52 are supported in independent way by respective input pulleys 53, 54 and exit pulleys 56, 57. The input pulleys 53, 54 are adjacent to the trailing edges of the inclined planes 41 and 42, and the exit pulleys 56, 57 are adjacent to an upper entry 58 and a lower entry 59, respectively, of the convergence unity 40. The pulleys of the groups 51, 52 have rotation axes lying on a horizontal plane, staggered with respect to the axes of the other pulleys and inclined with respect to the trailing edges of the planes 41 and 42.

According to the represented form of execution of the invention, the conveyer belts of the groups 51 and 52 have an identical length. All the belts extend from the input pulleys 53, 54 to the exit pulleys 56, 57 through the entire approaching portions 33, 34 of the trajectories 28 and 29. Also the pulleys 56, 57 have the respective rotation axes inclined and staggered each other and parallel to the axes of the input pulleys 53, 54 for a planar configuration of rhomboidal appearance. The conveyer belts 51,52 are motorized either in cascade among the pulleys 53, 54, or by means of an intermediate motor roller engaged with the conveyer belts 51, 52.

Two groups of contrast belts 61, 62 and respective pulleys 63 and 64; 66 and 67 are associated to the groups of conveyer belts 51, 52. The groups 61 and 62 are specular with respect to the groups 51 and 52 and the pulleys 63 and 64; 66 and 67 are cinematically connected with the pulleys of the groups 51 and 52. The sheets 19-*a*, 19-*b* can be positively dragged between the upper sections of the belts of he groups 51 and 52 and the lower sections of the belts of the groups 61 and 62.

The pulleys and the conveyer belts of the groups 51, 52 are arranged under the movement surfaces 46 and 47 while the pulleys and the belts of the groups 61, 62 are ranged above these surfaces. The sheets will be engaged by the upper and lower sections of the conveyer and contrast belts tangent to the surfaces 46 and 47. With this structure, the sheets 19-*a* and 19*b* are susceptible of movement along horizontal surfaces comprising the convergence portions 33 and 34. It occurs with a minimum shifting of the sets firm the support plane 26, without any deflection and stop and according to a law of motion substantially linear.

Suitably, the distance "H" is dimensioned in such a way to consent the pulleys 64 and 67 of the groups 61 and the pulleys 53 and 56 of the group 52 to be one above the other without any obstacle to the movement of the sheets 19-*a* and 19-*b*.

Figure 7:
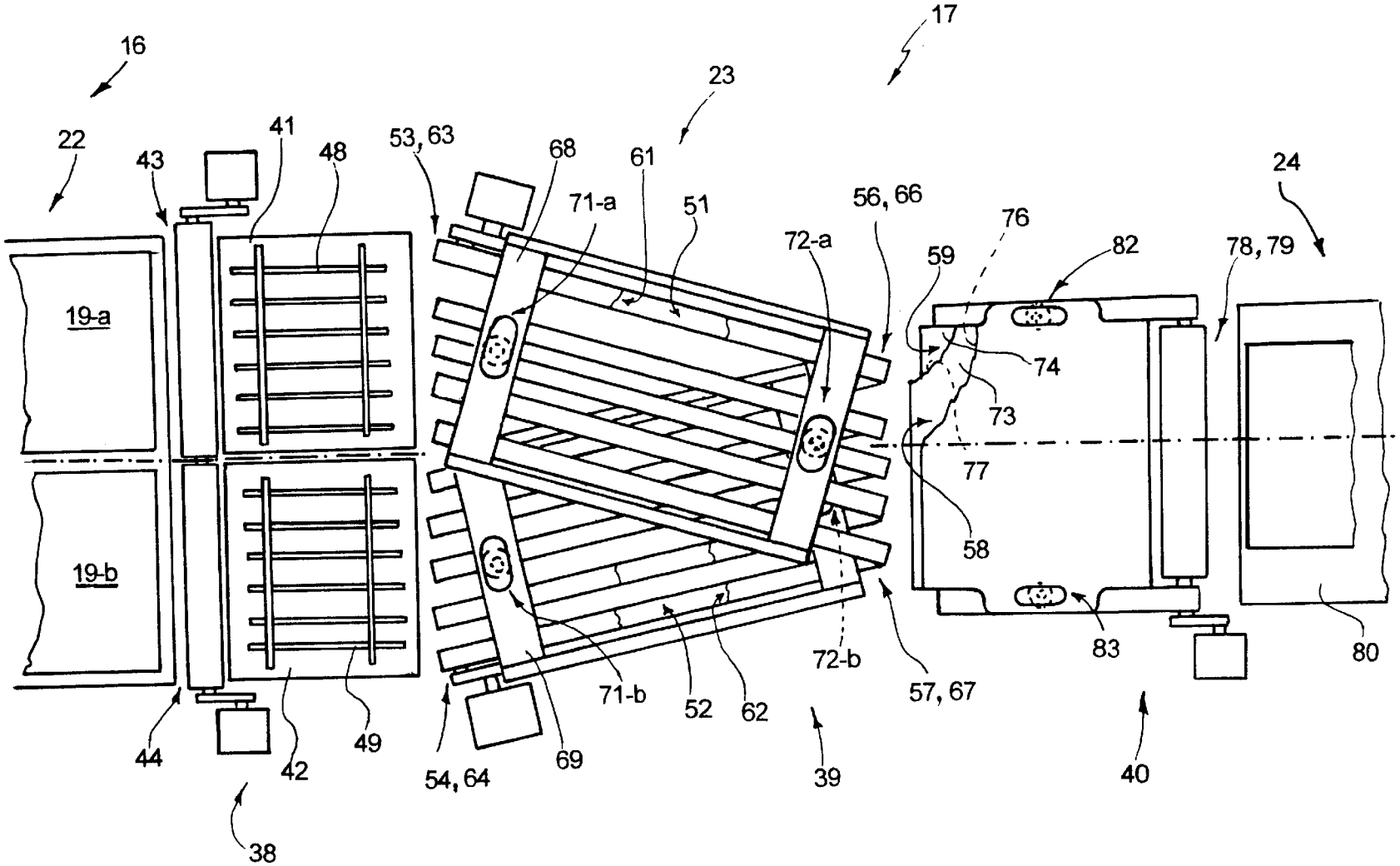
FIG. 7 represents a partial plan view of the device of Fig.6.

The pulleys of the groups of belts 51, 61 and 52, 62 are supported by frames 68, 69 each having capability of adjustment by means of two screw-and-notch couplings 71-*a*, 72-*a* and 71-*b*, 72-*b* (FIG. 7). Thus, the inclination of the conveyer belts and their position with respects to the trailing edge of the support plane 26 and the entries 58 and 59 of the convergence unity 40 can be modified for an optimal dynamic superposition of the printed sheets. The frames with the respective groups of belts can be removed for the access to the movement surfaces of the sheets 19-*a* and 19-*b*.

The convergence unity 40 includes two couples of guide planes 73 and 74 and contrast planes 76 and 77 and a couple of extraction rollers 78, 79. The couples of planes 73, 76 and 74, 77 are descendant and ascendant, respectively, and are aligned with the entries 58 and 59. These planes define two guided channels for the sheets 19-*a* and 19-*b*, which are spaced the one with respect to the other and in a condition of overlapping. The channels are concurrent toward a common exit adjacent to the extractor rollers 78, 79. The rollers provide to drag the sheets 19-*a*, 19-*b* from the exit of the channels and the surfaces 46 and 47 to the collecting station 24 along a direction of movement substantially coincident with the longitudinal axis 27.

The guide planes 73 and 74 and the contrast planes 76 and 77 are laterally limited by two walls 81 and have capability of longitudinal adjustment with respect to the rollers 78, 79 for a dynamic optimal stacking of the printed sheets. For example, it is performed by screw-and-notch couplings 82, 83.

The collecting station 24 comprises a supporting plane 80 and delivery means not shown in the drawings. The plane 80 is arranged at the entry of the collecting station 24 and is delimited by a longitudinal controlled arrest element 84 (see FIG. 4) and two lateral slide bars 86 and 87 for forming the file 21. The sheets 19-*a*, 19-*b* superposed and in movement can be arrested by the element 84 and leveled in the file by the element 84 and the bars 86 and 87. Thereafter, the delivery means will provide to deliver the formed file to the conveyer belt 2.0 of the machine.

The operation of the sequencer 17 is the following:

In the input section 22, the form 18 is cut in manner to forming the flanked sheets 19-*a* and 19-*b* and presenting them on the support plane 26 against the extractors 43 and 44. The motorized rollers move the sheets 19-*a* and 19-*b* longitudinally on the planes 42 and 41, respectively salient and descending, maintaining the relation of flanking thereof and the transversal horizontal trim.

The sheets 19-*a* and 19-*b* are engaged by the leading edges of the belts of the groups 51 and 61 and the belts of the groups 52 and 62, respectively, in synchronism with the extractors 43 and 44. The conveyer belts drag the sheets on the surfaces 46 and 47 (see FIG. 3) in diagonal up to reaching, in projection, a condition of symmetry with respect to the longitudinal axis 27.

In the case in which both the sheets 19-*a* and 19-*b* are moved together, these sheets will result in an overlapping relationship on the surfaces 46 and 47. The movement of the sheets is linear and includes an approaching transversal component equal to the half of the width "W". Then, the sheets 19-*a* and 19-*b* are pushed by the conveyer belts along the channels defined by the planes 73, 74 and the walls 81 toward the supporting plane 80 and against the arrest element 84. The lower surface of the sheet 19-*a* will be superimposed on the upper surface of the sheet 19-*b*, while the slide bars 86 and 87 level the edges of all the sheets.

If the files 21 include an odd number of sheets, for instance three sheets 19-1, 19-2 and 19-3 of the set of sheets 19-1 to 19-6, the sequence of print on the sheets is (3), (1), (2). The sheets 19-1 and 19-2 are separated from the form and moved together as above described. The sheet 19-2 will be deposited on the supporting plane 80 and the sheet 19-1 will be superposed on the sheet 19-2.

On the contrary, after the separation from the form of the sheets 19-3 and 194, only the extractor 43 and the conveyer belts of the groups 53 and 63 are actuated. Thus the sheet 194 remains on the plane 26 and the sheet 19-3 is moved along the trajectory 28 and stacked over the sheet 19-1. Thereafter, the formed file is delivered from the collecting station 24 to the conveyer 20.

The forming of the other file requires the actuation of the extractor 44 and the conveyer belts of the groups 52 and 62. The arrested sheet 19-4 will be moved along the trajectory 29 and deposited on the supporting plane 80. Then, the sheets 19-5 and 19-6 are separated from the form 18 and moved together as above described. The sheet 19-6 will be deposited on the sheet 19-4, the sheet 19-5 will be superpose on the sheet 19-6 and the formed file will be delivered to the conveyer 20.

The dynamic sequencer of the invention results of high speed with the capability of collecting files having an even or an odd number of sheets and performing an accurate overlapping of the sheets.

Advantageously, the files are formed with the same disposition of the sheets used for the print. Therefore, the data on the first sheet of the file can be directly observed on the upper surface of the first sheet. Further, the files can be moved along the longitudinal axis of the sheets for a following enveloping process to be executed in a natural way.

In alternative to the continuous form, the dynamic sequencer 17 can use stacks of double width sheets fed by a suitable sheet feeder. In this case, the cutter of the input section 22 is simple and executes only the longitudinal cutting for the separation of the two sheets from the single double width sheet fed by the feeder. The sequencing of the sheets for the forming of the file results the same as for the sheets separated from the continuous form. A sequencer of his type is particularly useful for the forming of files of "A4" sized sheets derived from printed sheets fed by a feeder for "A3" sized sheets.

A sequencer 17 using a continuous form can provide a cutter of the input section 22 which, in addition to the longitudinal cutting, is adapted to execute transversal cuttings starting from the two sides of the form 18 and selectively limited to the width "W" for the separation of a single sheet. The unit 38 includes a single extractor with a motorized taking-up roller and contrast rollers for extracting either the two sheets 19-*a* and 19-*b* or the sole sheet 19-*a* or 19-*b* jointly or singularly separated from the form.

In the first case, the sheets are moved in pair. In the second case, the cutter separates a sole sheet and the motorized roller acts and moves the separated sheet whilst it slides without effect on the sheet attached to the form. The arrested sheet will be moved for the forming of the following files only after the actuating of the cutter and its separation from the form 18.

As further alternatives, the divergence unity 38, the crossing unity 39 and the convergence unity 40 can modify the trajectory of a sole sheet 19-*a* or 19-*b* for reaching the desired overlapping in the file.

In a second form of execution of the invention, not represented in the drawings, the conveyer and/or contrast belts of the groups 51, 61; 52, 62 have different lengths, scaled from the half of the portions of trajectory 33, 34 and split. A series of intermediate pulleys is added to the first and the second plurality of pulleys. The intermediate pulleys are fixed on a common motor axis disposed in a median position with respect to the pulleys 53, 54; 56, 57.

Naturally, the principle of the disclosure remaining the same, the embodiments and the details of manufacture may be widely varied with respect to that described and illustrated by way of non-limitative example, without, by this, departing from the ambit of the present invention.

We claim:

1. A dynamic sequencer for two-up and slalom printed sheets of a file comprising an input section for two sheets lying in a flanking relationship;

a collecting station for superposed sheets forming a file along a longitudinal axis; and overlapping means for moving the printed sheets from the input section to the collecting station along two respective trajectories providing a transversal constant trim;

said trajectories including at least a divergent portion divergent in height from the input section, at least an approaching portion for approaching, in projection, at least a sheet toward another sheet in a superimposed configuration and at least a concurrent portion for causing at least a sheet to be concurrent in height toward said collecting station in a superimposed relationship with respect to another sheet of the file.

2. A sequencer according to claim 1 in which said divergent portion of trajectory is descendant with respect to the input section for guiding a sheet on a lower movement surface below said input section.

3. A sequencer according to claim 1 in which said divergent portion of trajectory is ascendant with respect to the input section for guiding a sheet on an upper movement surface above said input section.

4. A sequencer according to claim 1, in which said input section includes a supporting plane for said two sheets and in which said overlapping means comprise a divergence unit for guiding and moving said sheets along two divergent portions of said trajectories, said divergence unity comprising an inclined descendant plane for guiding a sheet on a movement surface below said supporting plane and an inclined ascendant plane for guiding a sheet on a movement surface above said supporting plane.

5. A dynamic sequencer according to claim 4, further comprising upper guide elements for guiding the sheets on said inclined planes and in which said upper guide elements have capability of removal from said inclined planes.

6. A dynamic sequencer according to claim 4 further comprising couples of motorized taking up rollers adjacent to said input section for moving the sheets from the input section along said divergent portions, said rollers being differentially moveable for moving said sheets in pair or singularly and forming files with even or odd numbers of sheets.

7. A sequencer according to claim 6 in which the sheets are separated through longitudinal and transversal cuttings from a continuous form having a direction of advancement corresponding to a given longitudinal axis and in which said flanking relationship is referred to said longitudinal axis.

8. A sequencer according to claim 6 in which the sheets are separated by a stack of double width sheets of a sheet feeder device through longitudinal cuttings.

9. A dynamic sequencer according to claim 1 in which said two sheets are moved along two longitudinal flanked directions, and in which said overlapping means include a group of conveyor belts for one of said two sheets, said conveyor belts having a direction of dragging inclined with respect to one of the two directions and concurrent toward the other direction.

10. A sequencer according to claim 1, wherein said flanking relationship is referred to a longitudinal axis and in which said overlapping means comprises a crossing unity for guiding and moving said sheets, in projection, toward said longitudinal axis along two approaching portions of said trajectories.

11. A dynamic sequencer according to claim 10 in which said crossing unity includes a first group of conveyor belts for one of said two sheets, the conveyor belts of said first group having a direction of dragging inclined with respect to one of the two directions and concurrent toward the other direction.

12. A dynamic sequencer according to claim 11 wherein said crossing unity comprises a second group of conveyor belts for the other sheet and contrast belts for the first and the second group of conveyor belts, wherein said contrast belts are contrasted by the conveyor belts and cinematically connected with said conveyor belts for positively feeding said sheets, the second group of conveyor belts providing a direction of dragging inclined in a sense opposite with respect to the direction of dragging of the first group of conveyor belts.

13. A dynamic sequencer according to claim 12 wherein the conveyor belts of each group of conveyor belts have a same position but are staggered with respect to the conveyor belts of the other group in such a way to provide respective aligned take-up portions for simultaneously engaging the leading edge of a correspondent sheet.

14. A dynamic sequencer according to claim 12 in which said overlapping means comprises a divergence unity for guiding and moving said sheets along two divergent portions of the trajectories, in which said input section has a support plane for said sheets, and in which said divergence unity comprises an inclined plane descendant with respect to the support plane for guiding a sheet on a first movement surface below the support plane and an ascendant inclined plane for guiding another sheet on a second movement surface above said support plane, said first and said second movement surfaces being defined by upper sections of the carrying belts and lower sections of the contrast belts, and said movement surfaces being spaced apart a distance such to freely receive the contrast belts of the first group and the carrying belts of the second group.

15. A dynamic sequencer according to claim 14, wherein said groups of conveyor belts are adjustable with respect to said input section for regulating the inclination of said conveyor belts.

16. A dynamic sequencer according to claim 14, wherein each group of conveyor belts comprises a plurality of motorized conveyor belts and a correspondent first plurality of pulleys for said conveyor belts, said first plurality of pulleys having independent, staggered and inclined rotation axes.

17. A dynamic sequencer according to claim 16, wherein said conveyor belts have identical length, and in which said groups of conveyer belts comprise each a second plurality of pulleys for said belts having rotation axes staggered and inclined, parallel to the axes of the first plurality of pulleys.

18. A dynamic sequencer according to claim 16, wherein said conveyor belts have different length, and in which said groups of conveyor belts comprise each a second plurality of pulleys for said conveyor belts having a common rotation axis.

19. A dynamic sequencer according to claim 1 wherein said flanking relationship is referred to a longitudinal axis and wherein said overlapping means comprises a convergence unity for guiding and moving said sheets toward said longitudinal axis along two concurrent portions of said trajectories.

20. A sequencer according to claim 14 wherein said flanking relationship is referred to a longitudinal axis and wherein said overlapping means comprises a convergence unity for guiding and moving said sheets toward said longitudinal axis along two concurrent portions of said trajectories and wherein the groups of conveyor belts and the groups of contrast belts are mounted on two respective frames, said sequencer further comprising a mechanism for adjusting the inclination of the frames and the positions of the belts between the inclined planes and the convergence unity.

21. A sequencer according to claim 19 in which the sheets are cut from a continuous form having a given direction of advancement, wherein said convergence unity has two movement planes spaced apart the one respect to the other and concurrent toward the collecting station and extraction rollers for moving the sheets on said movement planes along a direction substantially coincident with the direction of advancement of said form.

22. A dynamic sequencer according to claim 21 wherein said planes have capability of longitudinal adjustment for an optimal matching of the sheets to be superimposed.

23. A sequencer device for dynamically forming files of sheets printed two-up and slalom comprising cutting means for defining two flanked sheets on an input plane and superimposing the sheets on an output plane, said device comprising means for moving the two sheets longitudinally on two surfaces respectively salient and descending, maintaining the relation of flanking on two movement surfaces spaced apart each other;

means for linearly approaching the two sheets on the two surfaces, up to reaching in projection, an overlapping relationship; and means for moving the sheets and overlapping the lower surface of a sheet with the upper surface of the other sheet.

24. A device according to claim 23, wherein said means for linearly approaching the two sheets comprise a crossing unity having conveyor belts lying on different planes inclined in projection.

25. A device according to claim 23, wherein said means for moving the sheets comprise a convergence unity having surfaces concurrent toward said output plane.

* * * * *